US008328493B2

(12) United States Patent
Gogola et al.

(10) Patent No.: US 8,328,493 B2
(45) Date of Patent: Dec. 11, 2012

(54) BEVERAGE CAN END SEAMING OPERATION TOOLING ASSEMBLY

(75) Inventors: Michael R. Gogola, Itasca, IL (US); Randall G. Forrest, Park Ridge, IL (US); Timothy L. Turner, Port Charlotte, FL (US)

(73) Assignee: Rexam Beverage Can Company, Chicago, IL (US)

( * ) Notice: Subject to any disclaimer, the term of this patent is extended or adjusted under 35 U.S.C. 154(b) by 539 days.

(21) Appl. No.: 12/535,459

(22) Filed: Aug. 4, 2009

(65) Prior Publication Data

US 2011/0033265 A1 Feb. 10, 2011

(51) Int. Cl.
*B21D 51/30* (2006.01)

(52) U.S. Cl. ..... 413/27; 413/42

(58) Field of Classification Search ..... 413/2–7, 413/27–44; 72/344

See application file for complete search history.

(56) References Cited

U.S. PATENT DOCUMENTS

| | | | | |
|---|---|---|---|---|
| 1,872,294 | A | 8/1932 | Hothersall | |
| 2,308,296 | A | 1/1943 | Mills | |
| 2,324,501 | A | 7/1943 | Geist | |
| 2,467,154 | A | 4/1949 | Peterson, Jr. | |
| 2,502,413 | A | 4/1950 | Birkland | |
| 2,739,556 | A | 3/1956 | Pechy | |
| 5,533,853 | A * | 7/1996 | Wu | 413/31 |
| 2002/0081172 | A1 * | 6/2002 | Wu | 413/27 |

* cited by examiner

*Primary Examiner* — Dana Ross
*Assistant Examiner* — Matthew G Katcoff
(74) *Attorney, Agent, or Firm* — Ungaretti & Harris LLP

(57) ABSTRACT

A knockout tool for removing a filled beverage container from a seaming tool subsequent to attachment to a can end during a seaming process has a main portion positioned about a longitudinal axis, and a plurality of engagement segments extending downwardly from the main portion.

11 Claims, 7 Drawing Sheets

BEVERAGE CAN END SEAMING OPERATION TOOLING ASSEMBLY

CROSS-REFERENCE TO RELATED APPLICATIONS

N/A

FEDERALLY SPONSORED RESEARCH OR DEVELOPMENT

N/A

TECHNICAL FIELD

The invention relates to tooling used in joining can ends to can bodies. More particularly, the present invention is directed to such tooling and removing a container from such tooling subsequent to a joining operation.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container.

The seaming process typically requires the container and the can end to be elevated and clamped between a base plate and a seaming chuck. A first set of seaming rollers are rotated about the seaming chuck along the open end of the container with sufficient pressure to form the first portion of a double joining seam. When the first step in forming the double seam has been completed, the first pair of opposed seaming rollers is retracted, and the seaming rollers of a second pair are actuated to complete the double seam. When the seaming of the can end to the can body is complete, the second set of seaming rollers is retracted, and the base plate piston is retracted. At the same time, a seamer knockout piston carried centrally of the seaming chuck is actuated to ensure freeing of the sealed container from the chuck to complete the seaming operation.

The can ends are generally provided with information on an upper or public side prior to seaming. The information is typically directed to recycling information and the like. The information is added to the end during the manufacture of the end by stamping or incising. The incising process leaves extra metal adjacent the lettering. A pressure within the can may also cause the center panel of the can end to flex or bow slightly upward. This may cause the incising to distort and/or flex upwardly as well. During seaming, the excess metal and/or the distorted incising may cause metal build up on the seamer knockout. Thinner gauge can ends also tend to pucker from the incising which may compound the build-up. As the excess material builds on the seamer knockout, it leaves a circumferential scratch on subsequent can ends as the rotating can ends are engaged by the stationary seamer knockout.

The present invention is provided to solve the problems discussed above and other problems, and to provide advantages and aspects not provided by prior tooling assemblies for seaming a can end to a can body of this type. A full discussion of the features and advantages of the present invention is deferred to the following detailed description, which proceeds with reference to the accompanying drawings.

SUMMARY OF THE INVENTION

A first aspect of the invention is directed to a knockout tool for removing a filled beverage container from a seaming tool subsequent to attachment to a can end during a seaming process. The knockout tool comprises a main portion positioned about a longitudinal axis and a plurality of engagement segments extending downwardly from the main portion.

The engagement segments of the first aspect of the invention may be angled radially outwardly relative to the longitudinal axis.

The engagement segments of the first aspect of the invention may be equally spaced about the longitudinal axis.

Each engagement segment of the first aspect of the invention may be comprise a first end joined to the main portion and a second end comprising an engagement surface. An intermediate portion of each engagement segment may be located between the first and second ends and angled radially outwardly relative to the longitudinal axis.

Each of the plurality of engagement segments of the first aspect of the invention may be separated from an adjacent engagement segment by an arcuate non-engagement segment.

Each of the plurality of engagement segments of the first aspect of the invention may be a separate finger having an engagement surface at a terminal end, each finger separated by a void region.

Each engagement segment of the first aspect of the invention may be a separate extension of the main portion.

A second aspect of the present invention is directed to a tooling assembly for attaching a can end to a filled beverage container. The tooling assembly comprises a seaming chuck and a knockout tool. The seaming chuck is positioned about a longitudinal axis and has a substantially circumferential radially outer surface for engagement with a chuckwall surface of the can end and an inner surface opposite the radially outer surface defining a chamber. The knockout tool is located at least partially within the chamber and comprises a plurality of radially outwardly extending engagement segments.

The seaming chuck chamber of the second aspect of the invention may comprise a plurality of sub-chambers extending radially outwardly from the chamber relative to the longitudinal axis.

Each engagement segment of the knockout tool of the second aspect of the invention may be located within a sub-chamber.

The plurality of engagement segments and the sub-chambers of the second aspect of the invention may be equally spaced about the longitudinal axis.

Each engagement segment of the second aspect of the invention may have an engagement surface located at a radially outer end of each engagement member.

The knockout tool of the second aspect of the invention may rotate at the same rate as the seaming chuck during the seaming process.

The radially outer end of each engagement segment of the second aspect of the invention may traverse in a direction parallel to the longitudinal axis within a corresponding sub-chamber.

A third aspect of the present invention is directed to a knockout tool for removing a filled beverage container from a seaming tool subsequent to attachment to a can end during a seaming process. The knockout tool comprises a main portion and an engagement surface. The main portion is positioned about a longitudinal axis. The engagement surface extends downwardly from the main portion and is for contacting a can end upon completion of the seaming process and is associated with a panel radius on an can end.

The engagement surface of the third aspect of the invention may contact the panel radius on the can end to remove the can end from a seaming chuck.

The knockout tool of the third aspect of the invention may further comprise a plurality of engagement segments extending radially outwardly relative to the longitudinal axis.

The plurality of engagement segments of the third aspect of the invention may be equally spaced about the longitudinal axis.

A fourth aspect of the present invention is directed to a tooling assembly for a seaming operation wherein a can end is attached to a filled beverage container. The tooling assembly comprises a seaming chuck. The seaming chuck has a radially outer surface adapted for engaging a chuckwall surface of a can end during the seaming operation, a radially inner surface defining an inner chamber, and a plurality of outer chambers extending radially outwardly from the inner chamber.

The tooling assembly of the fourth aspect may further comprise a knockout tool having a plurality of engagement surfaces each located within a corresponding outer chamber of the seaming chuck. The knockout tool may rotate about the longitudinal axis at substantially the same rate as the seaming chuck during the seaming operation.

A fifth aspect of the present invention is directed to a knockout tool for removing a filled beverage container from a seaming tool subsequent to attachment to a can end during a seaming process. The knockout tool comprises a main portion and a substantially annular lower surface. The main portion is positioned about a longitudinal axis. The substantially annular lower surface extends downwardly from the main portion. The lower surface comprises a plurality of engagement portions each separated by a corresponding recessed segment, wherein a lowermost vertical extent of each engagement portion lies below a lowermost vertical extent of each corresponding recessed segment.

The annular lower surface of the fifth aspect of the invention may have an undulating surface.

The engagement portions and the recessed portions of the fifth aspect of the invention may be joined through an arcuate segment.

The annular lower surface of the fifth aspect of the invention may form a smooth wave pattern. The smooth wave pattern may be circumferential.

The lowermost vertical extent of each engagement portion of the knockout tool of the fifth aspect of the invention may lie on a first common plane. The common plane may be perpendicular to the longitudinal axis. Further, an uppermost vertical extent of each recessed segment may lie on a second common plane. The second common plane may be perpendicular to the longitudinal axis.

The main portion of the knockout of the fifth aspect of the invention may be integral with the annular surface.

A sixth aspect of the present invention is directed to a knockout tool removing a filled beverage container from a seaming tool subsequent to attachment to a can end during a seaming process. The knockout tool comprises a main portion positioned about a longitudinal axis and a substantially annular lower surface extending downwardly from the main portion having an undulating surface. The undulating surface may comprise a plurality of engagement portions each separated by a corresponding recessed segment, wherein a lowermost vertical extent of each engagement portion lies below a lowermost vertical extent of each corresponding recessed segment.

A seventh aspect of the present invention is directed to a tooling assembly for attaching a can end to a filled beverage container. The tooling assembly comprises a seaming chuck and a knockout tool. The seaming chuck is positioned about a longitudinal axis and has a substantially circumferential radially outer surface for engagement with a chuckwall surface of the can end and a substantially circumferential radially inner surface defining a void. The knockout tool is located at least partially within the void and has a substantially annular lower portion including an undulating surface.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
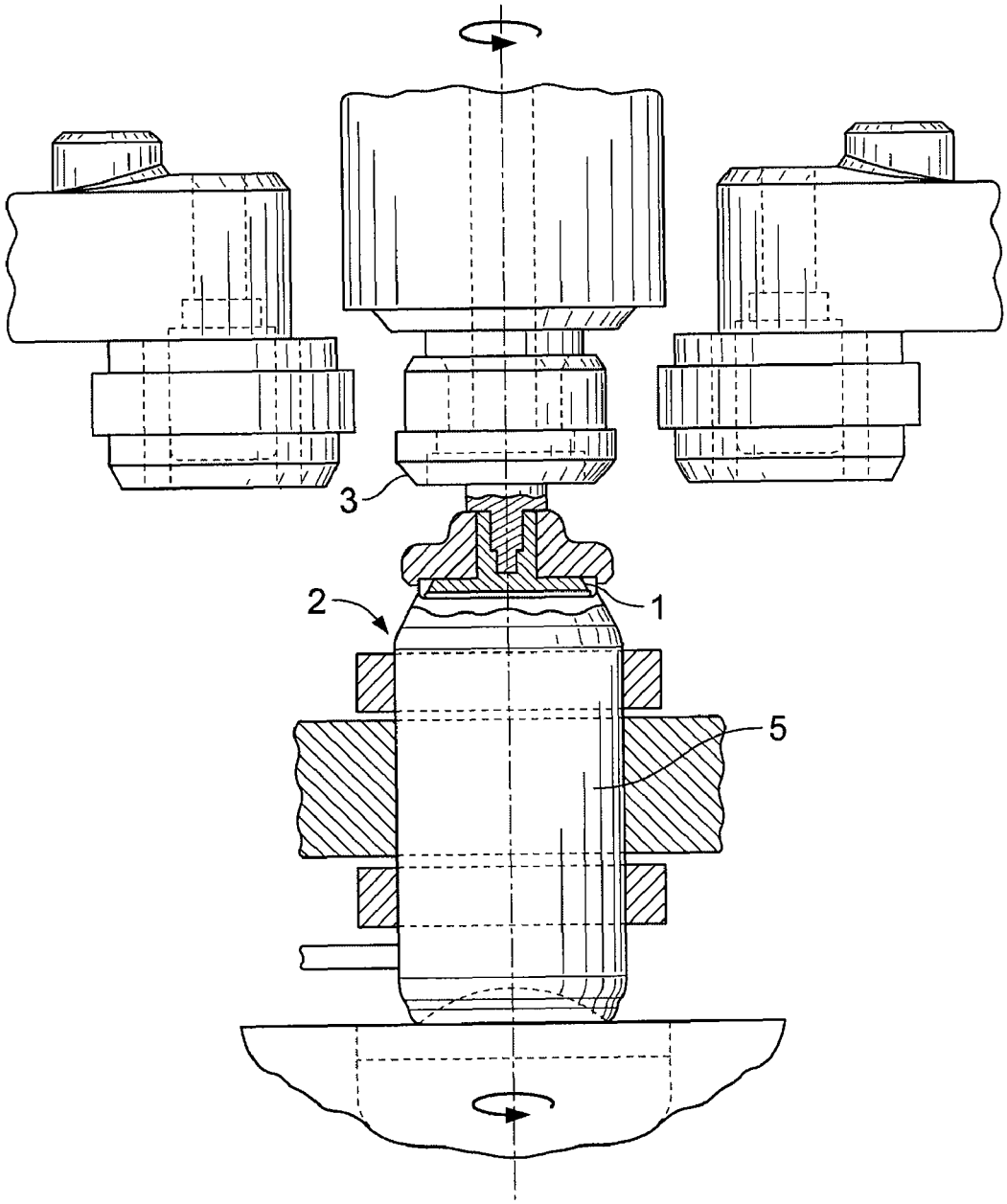
FIG. 1 is a side view of a can end seaming operation illustrating an extended seamer knockout in engagement with a can end upon completion of a seaming operation wherein the can end is seamed to a can body.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to can seaming equipment, the purpose of which is to attach a can end lid to a can body in a seaming operation.

Figure 2:
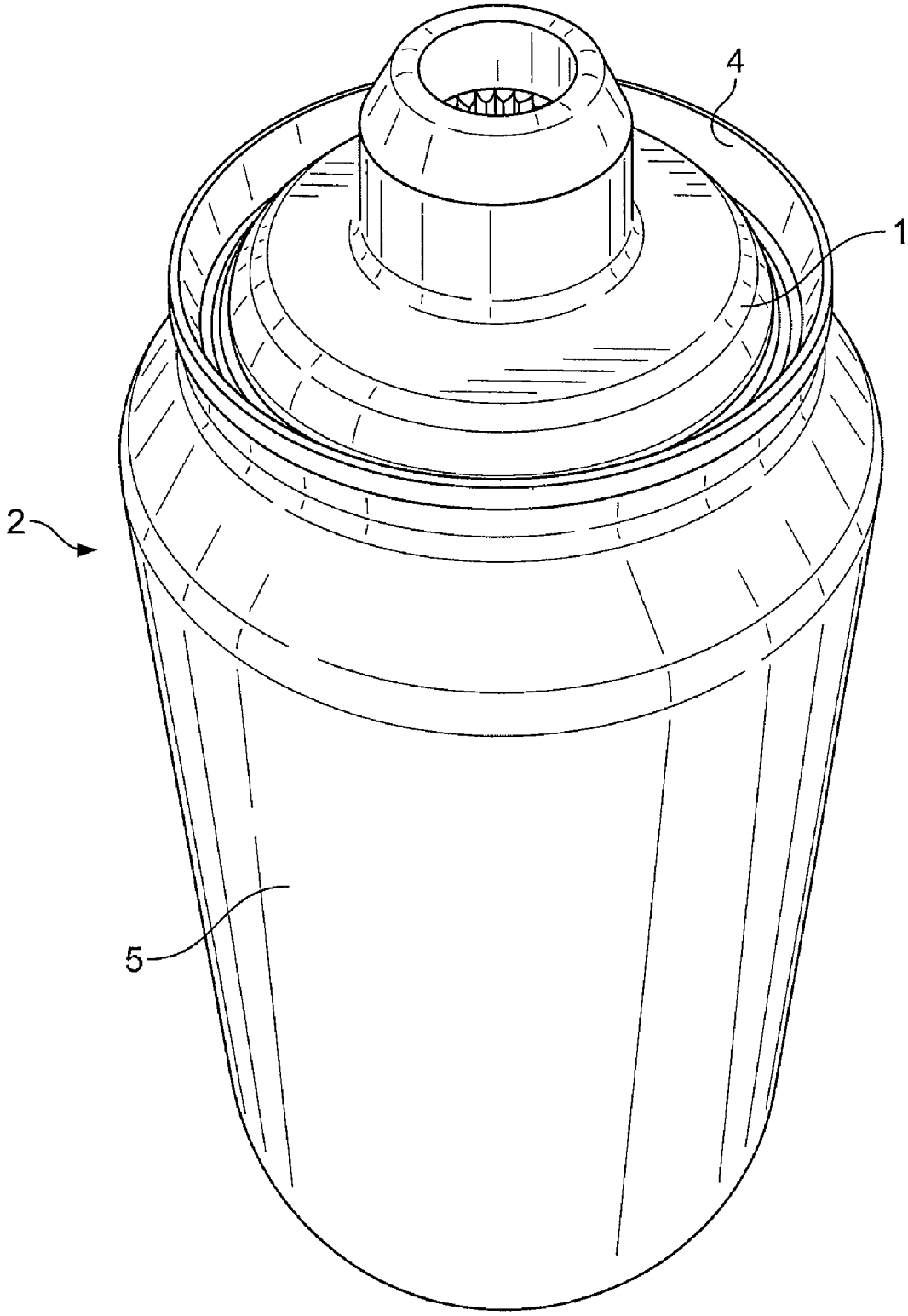
FIG. 2 is a perspective view of a can end seamed to a can body showing a seamer knockout in contact with the public side of the can end, the seamer knockout being removed from a seaming apparatus.

Referring to FIGS. 1-2, in a typical seaming operation, a knockout 1 removes the beverage container 2 from a seaming chuck 3 by engaging the can end 4 with a force. As shown in FIG. 2, the seamer knockout 1 contacts the public side of the center panel of the can end 4, radially inwardly of the attachment of the can end 4 to the can body 5.

Figure 4:
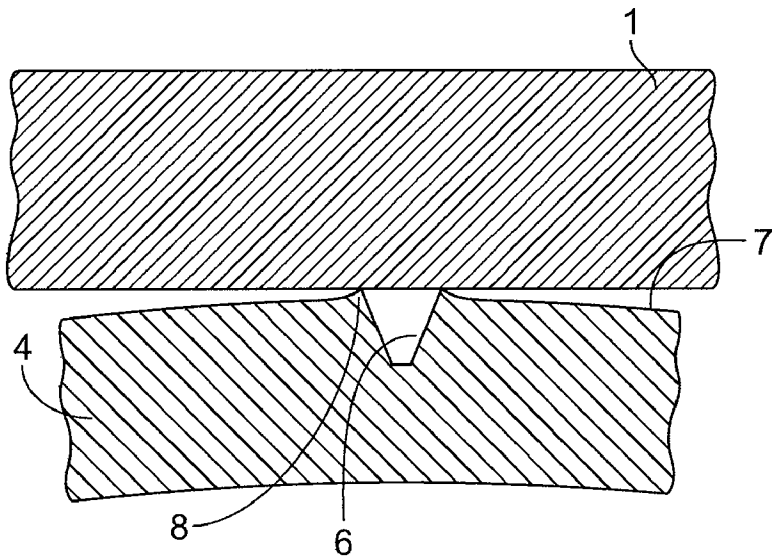
FIG. 4 is a partial cross-sectional view of the can end of FIG. 3 taken along 4-4 of FIG. 3 and further showing a seamer knockout in contact with excess metal from incising on the can end, a pressure within the seamed container causing a center panel of the can end to bow upwardly and distort the incising to cause further contact of the incising excess metal to engage the seamer knockout.
Figure 3:
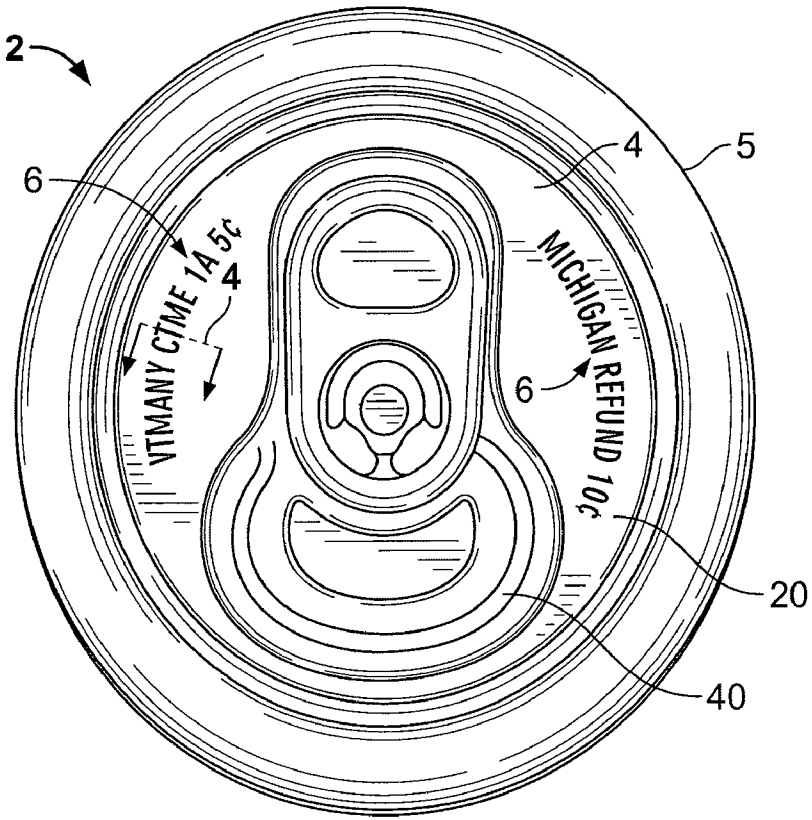
FIG. 3 is a top view of a can end seamed onto a can body.
Figure 6:
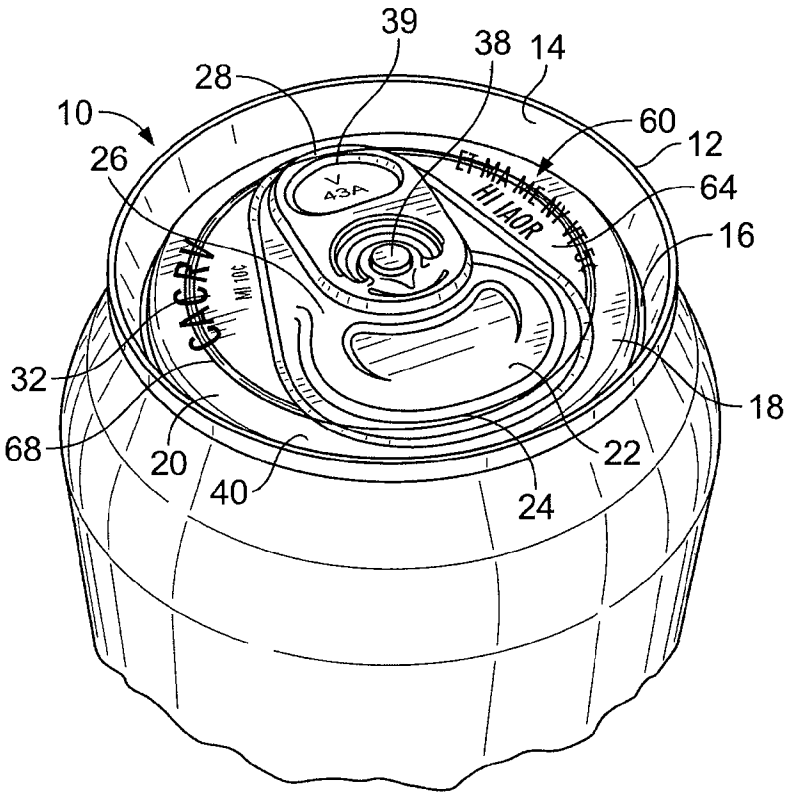
FIG. 6 is a perspective view of a can end after a seaming operation, a public side of the can end exhibiting an arc-shaped scratching caused by the seamer knockout and intersecting a recycling information located adjacent a peripheral edge of a center panel of the can end
Figure 5:
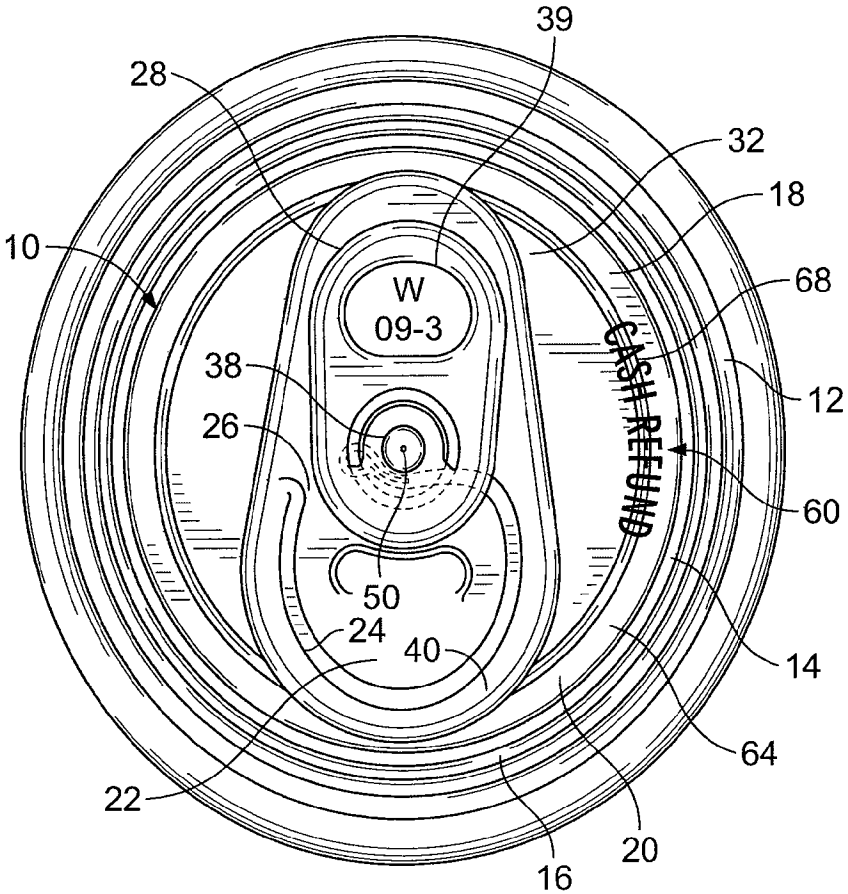
FIG. 5 is a top view of a can end exhibiting a scratched center panel adjacent an incising.

Referring to FIGS. 3-4, the can end 4 is generally provided with information 6 on an upper or public side 7 prior to seaming. The information is added to the end 4 during the manufacture of the end 4 by stamping or incising. The incising process leaves extra metal 8 adjacent the lettering 6. A pressure within the can may also cause the center panel of the can end to flex or bow slightly upward. This may cause the incising to distort and/or flex upwardly as well. During seaming, the excess metal 8 and/or the distorted incising may cause metal build up on the seamer knockout 1. Thinner gauge can ends 4 also tend to pucker, or have a waving surface, from the incising which may compound the build-up. As the excess material 8 builds on the seamer knockout 1, it may leave a circumferential scratch on subsequent can ends as the rotating can ends are engaged by the stationary seamer knockout 1 as shown in FIGS. 5 and 6.

Referring to 7-9, a tooling assembly 100 for seaming or attaching a can end lid to a filled beverage can body and a knockout tool 104 are illustrated. The tooling assembly 100 works in much the same way a prior art tooling assembly would function. Namely, the knockout tool 104 fits within a central chamber 108 of a seaming chuck 112. Once the can end lid is seamed to the can end body, the knockout tool 104 descends to remove the seaming chuck 112 from the can end lid. In this embodiment of the invention, the seaming chuck 112 is identical to those known in the art.

The knockout tool 104 of this embodiment has a main portion 116 positioned about a longitudinal axis 50, preferably centered about the axis 50. A plurality of engagement segments 120 extend downwardly from the main portion 116. The purpose of the engagement segments 120 is to make limited contact with a can end lid during the removal process of the seaming chuck 112 from the can end lid, as opposed to full circumferential contact by a single engagement segment having a circumferential engagement surface as is well known in the prior art. The engagement segments 120 of this embodiment are preferably equally spaced about the longitudinal axis 50 and extend radially outwardly relative to the longitudinal axis 50. Each engagement segment 120 has a first end joined to the main portion and a second end comprising a discreet engagement surface 124. Accordingly, the knockout tool 104 preferably has a plurality of engagement surfaces 124, corresponding in number to the number of engagement segments 120. This structure is created as a first end of each engagement segment 120 is joined to the main portion 116 while an opposing end terminates in an engagement surface 124.

Each engagement segment 120, and, necessarily, each engagement surface 124, is separated from an adjacent engagement segment 120 by a recessed or non-engagement segment 128. The purpose of the non-engagement segments 128 is to provide a relief area from knockout tool 104 contact with the can end lid during the seaming process as the knockout tool 104 removes the seaming chuck 112 from the seamed container. In other words, the knockout tool 104 surface area in contact with the can end lid is reduced by the area of a non-engagement surface 132 at the terminal end of each non-engagement segment 128. It is preferred for a lowermost vertical extent of each engagement segment 120 to lie on a first common plane and a lowermost vertical extent of each non-engagement segment 128 to lie on a second common plane wherein the second common plane is elevated above the first common plane.

The combination of the engagement surfaces 124 and the non-engagement surfaces 132 preferably forms a circumferential undulating surface. Further, each non-engagement surface is arcuate in shape. More preferably, each engagement surface 124 is also arcuate in shape. This arrangement forms an annular smooth wave pattern as illustrated. Finally, each engagement surface 124 also preferably has a radius of curvature to further minimize contact with the can end lid rather than being a flat or planar surface as is practiced in the prior art.

Figure 7:
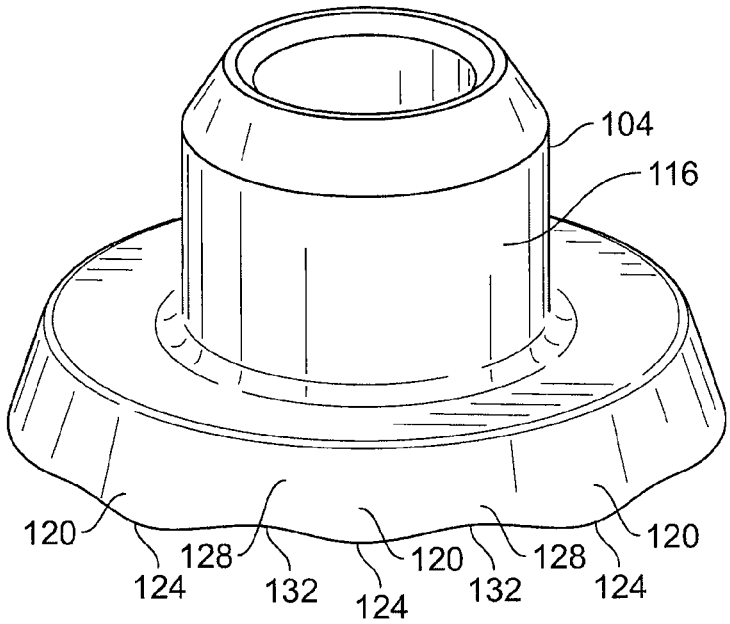
FIG. 7 is a perspective view of a knockout tool having a scalloped engagement surface.
Figure 8:
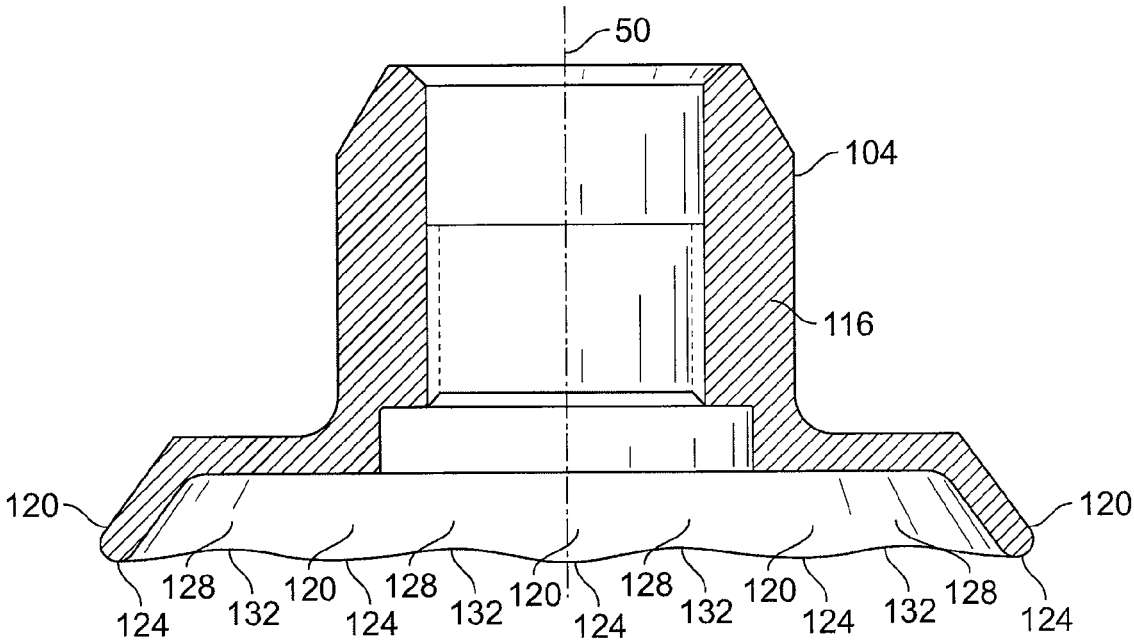
FIG. 8 is a cross-sectional view of the knockout of FIG. 7.
Figure 9:
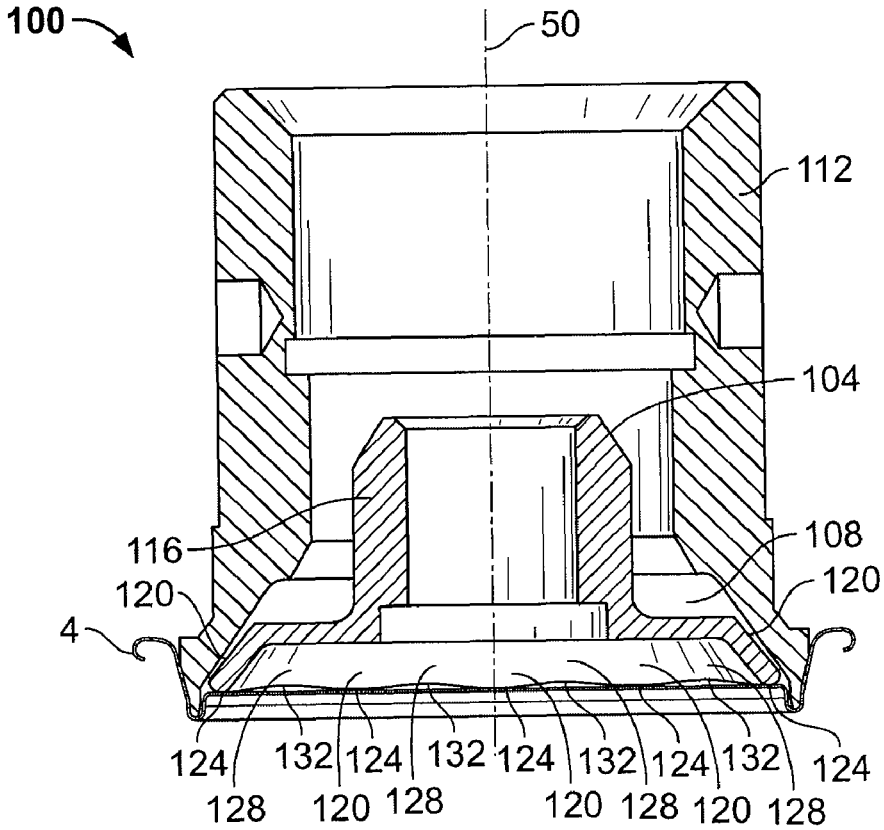
FIG. 9 is a cross-sectional view of a tooling assembly for seaming a can end lid to a can body, the tooling assembly featuring a knockout tool having a scalloped engagement surface.
Figure 10:
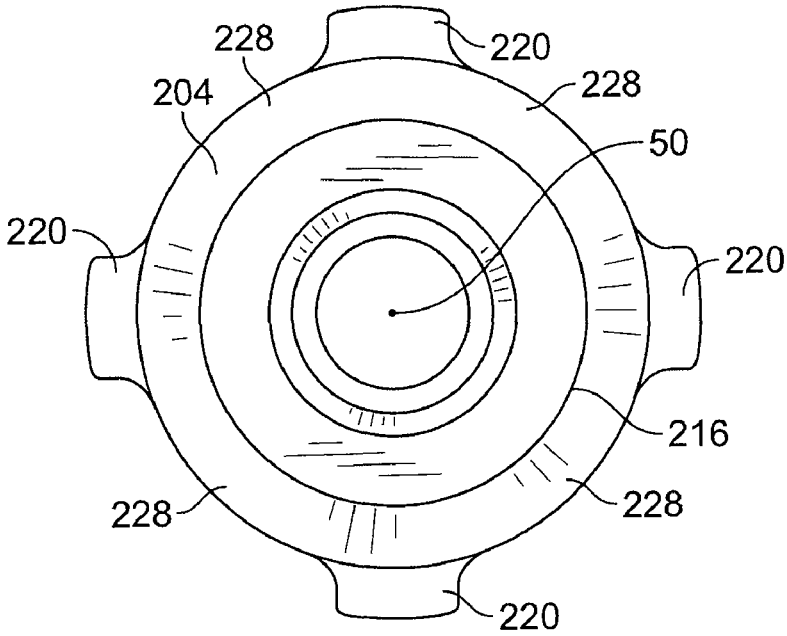
FIG. 10 is a top view of a knockout tool having a segmented engagement surface.
Figure 11:
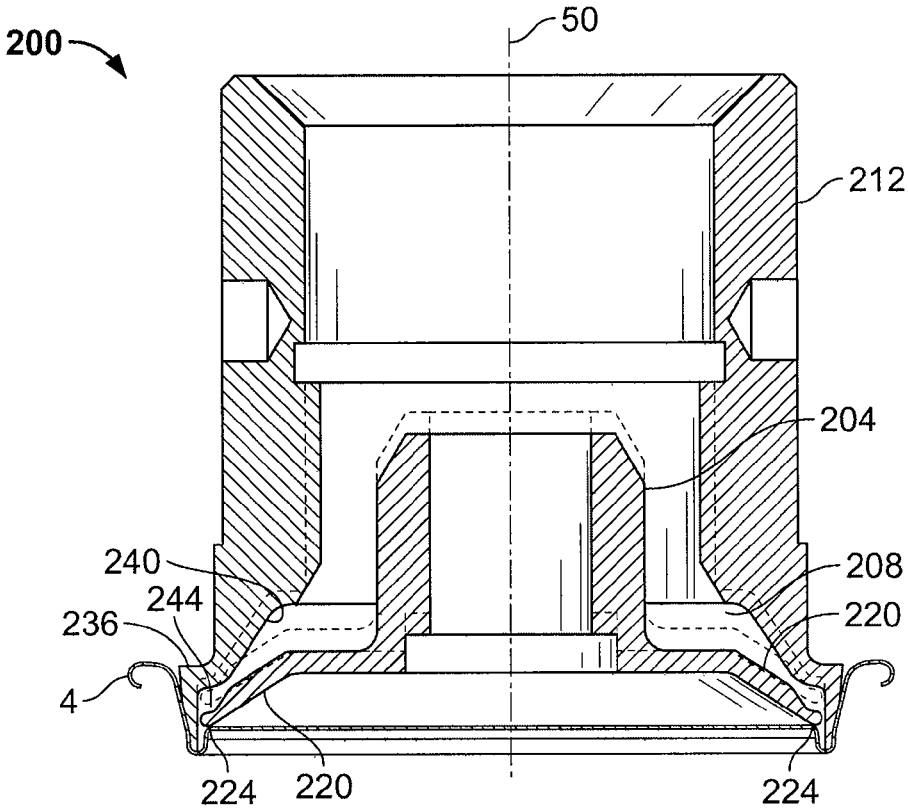
FIG. 11 is a cross-sectional view of a tooling assembly for seaming a can end lid to a can body, the tooling assembly featuring a knockout tool having a segmented engagement surface, and the seaming chuck having a plurality of sub-chambers adapted for receiving engagement segments of the knockout tool.
Figure 12:
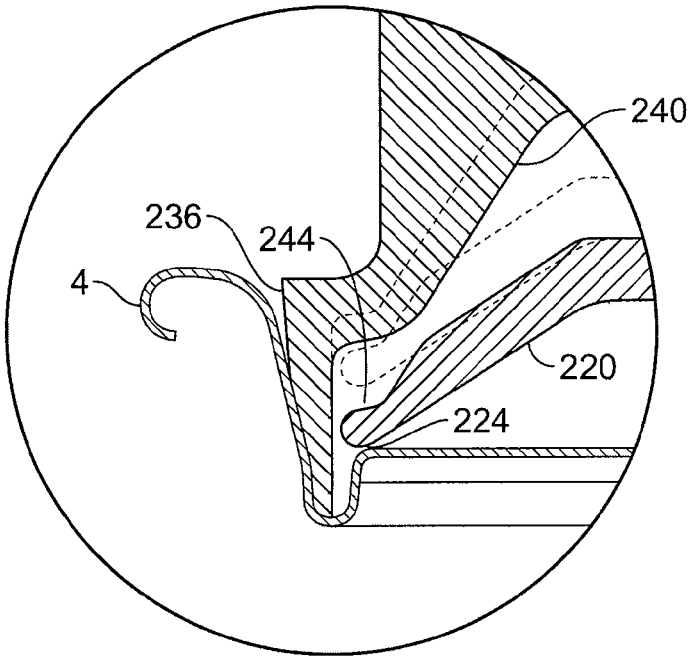
FIG. 12 is a magnified portion of the assembly FIG. 11.

Now referring to FIGS. 10-12, a second tooling assembly 200 includes a knockout tool 204 and a seaming chuck 212. Similar to the tooling assembly 100 of FIGS. 7-9, the tooling assembly of this embodiment requires a new and unobvious knockout tool 204. However, the tooling assembly 200 of this embodiment further requires a new an unobvious seaming chuck 212.

The knockout tool 204 of this embodiment also has a main portion 216 positioned about a longitudinal axis 50, preferably centered about the axis 50. A plurality of engagement segments 220 extend downwardly from the main portion 216. The purpose of the engagement segments 220 is to make limited contact with a can end lid during the removal process of the seaming chuck 212 from the can end lid, as opposed to full circumferential contact by a single engagement segment having a circumferential engagement surface as is well known in the prior art. The engagement segments 220 of this embodiment are preferably equally spaced about the longitudinal axis 50 and extend radially outwardly relative to the longitudinal axis 50. Each engagement segment 220 has a first end joined to the main portion and a second end comprising a discreet engagement surface 224. Accordingly, the knockout tool 204 has a plurality of engagement surfaces 224, corresponding in number to the number of engagement segments 220, preferably four (4). This structure is created as a first end of each engagement segment 220 is joined to the main portion 216 while an opposing end terminates in an engagement surface 224.

Each engagement segment 220, and, necessarily, each engagement surface 224, is separated from an adjacent engagement segment 220 by a recessed or non-engagement segment 228. The purpose of the non-engagement segments 228 is to provide a relief area from knockout tool 204 contact with the can end lid during the seaming process as the knockout tool 204 removes the seaming chuck 212 from the seamed container. In other words, the knockout tool 204 surface area in contact with the can end lid is reduced by the area of a non-engagement surface at the terminal end of each non-engagement segment 228. It is preferred for a lowermost vertical extent of each engagement segment 220 to lie on a first common plane and a lowermost vertical extent of each non-engagement segment 228 to lie on a second common plane wherein the second common plane is elevated above the first common plane.

This knockout 204 differs from the knockout 104 of the previous embodiment in that each engagement segment 220 is a separate, discreet finger having a separate, discreet engagement surface 224 at a terminal end thereof. Thus, each engagement segment 220 is a separate extension of the main portion 216. A radially outwardly angling of each finger locates each engagement surface 224 such that it is associated with a panel radius of a can end lid at the peripheral edge of the center panel. This allows the engagement surfaces 224 to be positioned radially outwardly of any incising on the can end lid which would eliminate any pick-up on the knockout tool 204 caused by contact with excess metal produced during the incising process. In other words, the engagement surfaces 224 contact the panel radius or peripheral edge of the center panel to remove the can from the seaming chuck 212 once the can end has been seamed to the can body. Finally, each engagement surface 224 also preferably has a radius of curvature to further minimize contact with the can end lid rather than being a flat or planar surface as is practiced in the prior art.

The seaming chuck 212 of this embodiment has a substantially circumferential radially outer surface 236 for engagement with a chuckwall surface of the can end and an inner surface 240 opposite the radially outer surface 236 defining a chamber 208. The chamber 208 has a plurality of sub-chambers 244, preferably equal to the number of engagement segments 220, extending radially outwardly from the chamber 208. The sub-chambers 208 effectively extend or enlarge the volume of the chamber 208 to allow the engagement surfaces 224 to be associated with the panel radius of the can end. Accordingly, each discreet, separate engagement segment 220 of this embodiment is located within a corresponding sub-chamber in the seaming chuck 212 and descends within the sub-chamber 244 is a direction parallel to the longitudinal axis 50 to contact the can end lid.

In use, the knockout tool 204 rotates with the seaming chuck 212 and at the same rate as the seaming chuck 212 during seaming. This differs from the embodiment of FIGS. 7-9 and the prior art where the knockout tool is stationary and contacts a rapidly rotating can during the removal of the seaming chuck from the seamed container.

The terms "first," "second," "upper," "lower," etc. are used for illustrative purposes only, used in relative terms, and are not intended to limit the embodiments in any way. The term "plurality" if used herein is intended to indicate any number greater than one, either disjunctively or conjunctively as necessary, up to an infinite number. The terms "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

While the specific embodiments have been illustrated and described, numerous modifications come to mind without significantly departing from the spirit of the invention, and the scope of protection is only limited by the scope of the accompanying Claims.

What is claimed is:

1. A tooling assembly for attaching a can end to a filled beverage container, the tooling assembly comprising:

a seaming chuck positioned about a longitudinal axis, the seaming chuck having a substantially circumferential radially outer surface for engagement with a chuckwall surface of the can end and an inner surface opposite the radially outer surface defining a chamber;

and a knockout tool located at least partially within the chamber and comprising a plurality of engagement segments, wherein each engagement segment is separated from an adjacent engagement segment by a corresponding recessed segment.

2. The tooling assembly of claim 1 wherein each engagement segment has an engagement surface located at a radially outer end of each engagement member.

3. The tooling of claim 2 wherein the plurality of engagement segments extend radially outwardly.

4. The tooling assembly of claim 3 wherein the seaming chuck chamber comprises a plurality of sub-chambers extending radially outwardly from the chamber relative to the longitudinal axis.

5. The tooling assembly of claim 4 wherein each engagement segment of the knockout tool is located within a sub-chamber.

6. The tooling assembly of claim 5 wherein the plurality of engagement segments and the sub-chambers are equally spaced about the longitudinal axis.

7. The tooling assembly of claim 6 wherein the knockout tool rotates at the same rate as the seaming chuck during the seaming process.

8. The tooling assembly of claim 2 wherein the knockout tool has a substantially annular lower portion including an undulating surface.

9. The tooling assembly of claim 1 wherein each engagement segment has an engagement surface extending downwardly from the main portion of the knockout tool for contacting a can end upon completion of the seaming process, each engagement surface associated with a panel radius on a can end.

10. The tooling assembly of claim 3 wherein the engagement surface contacts the panel radius on the can end to remove the can end from a seaming chuck.

11. The tooling assembly of claim 1, wherein a lowermost vertical extent of each engagement segment lies below a lowermost vertical extent of each corresponding recessed segment.

* * * * *